US007068801B1

(12) United States Patent
Stinson et al.

(10) Patent No.: US 7,068,801 B1
(45) Date of Patent: Jun. 27, 2006

(54) MICROPHONE ARRAY DIFFRACTING STRUCTURE

(75) Inventors: Michael R. Stinson, Gloucester (CA); James G. Ryan, Gloucester (CA)

(73) Assignee: National Research Council of Canada, Ottawa (CA)

( * ) Notice: Subject to any disclaimer, the term of this patent is extended or adjusted under 35 U.S.C. 154(b) by 0 days.

(21) Appl. No.: 09/465,396

(22) Filed: Dec. 17, 1999

Related U.S. Application Data

(60) Provisional application No. 60/112,950, filed on Dec. 18, 1998.

(51) Int. Cl.
*H04R 25/00* (2006.01)

(52) U.S. Cl. ..... 381/160; 381/356; 381/92

(58) Field of Classification Search ..... 381/92, 381/160, 356, 361, 91, 122
See application file for complete search history.

(56) References Cited

U.S. PATENT DOCUMENTS

| | | | | |
|---|---|---|---|---|
| 4,802,227 A | | 1/1989 | Elko et al. | |
| 4,904,078 A | | 2/1990 | Gorike | |
| 5,539,834 A | | 7/1996 | Bartlett et al. | |
| 5,592,441 A | | 1/1997 | Kuhn | |
| 5,742,693 A | | 4/1998 | Elko | |
| 5,808,243 A | * | 9/1998 | McCormick et al. | 381/91 |
| 6,041,127 A | * | 3/2000 | Elko | 381/92 |

FOREIGN PATENT DOCUMENTS

EP 0 869 697 10/1998

OTHER PUBLICATIONS

"Super directivity design for a sphere-buffed microphone array" J. Acoust. Soc. Am., vol. 103, No. 5, May 1998, Kawahara and Fukudome.
"A steerable and variable first-oder differential microphone array", Intl. Conf. On accoustics, Speech and Signal,Processing, 1997, Elko and Pong.
"A Method of Interpolating the Diffractive Information of the Spere-Baffled Microphone in the Sound Field of Sperical Wave" Dept. Of Acoustic Design, Japan, Fukudome.

* cited by examiner

*Primary Examiner*—Brian T. Pendleton
(74) *Attorney, Agent, or Firm*—Marks & Clerk; Richard J. Mitchell

(57) ABSTRACT

The present invention increases the aperture size of a microphone array by introducing a diffracting structure into the interior of a microphone array. The diffracting structure within the array modifies both the amplitude and phase of the acoustic signal reaching the microphones. The diffracting structure increases acoustic shadowing along with the signal's travel time around the structure. The diffracting structure in the array effectively increases the aperture size of the array and thereby increases the directivity of the array. Constructing the surface of the diffracting structure such that surface waves can form over the surface further increases the travel time and modifies the amplitude of the acoustical signal thereby allowing a larger effective aperture for the array.

2 Claims, 13 Drawing Sheets

MICROPHONE ARRAY DIFFRACTING STRUCTURE

This application claims the benefit of Provisional Application No. 60/112,950, filed Dec. 18, 1998.

FIELD OF THE INVENTION

The present invention relates to microphone technology and specifically to microphone arrays which can achieve enhanced acoustic directionality by a combination of both physical and signal processing means.

BACKGROUND OF THE INVENTION

Microphone arrays are well known in the field of acoustics. By combining the outputs of several microphones in an array electronically, a directional sound pickup pattern can be achieved. This means that sound arriving from a small range of directions is emphasized while sound coming from other directions is attenuated. Such a capability is useful in areas such as telephony, teleconferencing, video conferencing, hearing aids, and the detection of sound sources outdoors. However, practical considerations mitigate against physically large arrays. It is therefore desirable to obtain as much acoustical directionality out of as small an array as possible.

Normally, reduced array size can be achieved by utilizing superdirective approaches in the combining of microphone signals rather than the more conventional delay and sum beamforming usually used in array signal processing. While superdirective approaches do work, the resulting array designs can be very sensitive to the effects of microphone self noise and errors in matching microphone amplitude and phase responses.

A few approaches have been attempted in the field to solve the above problem. Elko, in U.S. Pat. No. 5,742,693 considers the improved directionality obtained by placing a first order microphone near a plane baffle, giving an effective second order system. Unfortunately, the system described is unwieldy. Elko notes that when choosing baffle dimensions, the largest possible baffle is most desirable. Also, to achieve a second order response, Elko notes that the baffle size should be in the order of at least one-half a wavelength of the desired signal. These requirements render Elko unsuitable for applications requiring physically small arrays.

Bartlett et al, in U.S. Pat. No. 5,539,834 discloses achieving a second order effect from a first order microphone. Bartlett achieves a performance enhancement by using a reflected signal from a plane baffle. However, Bartlett does not achieve the desired directivity required in some applications. While Bartlett would be useful as a microphone in a cellular telephone handset, it cannot be readily adapted for applications such as handsfree telephony or teleconferencing in which high directionality is desirable.

Another approach, taken by Kuhn in U.S. Pat. No. 5,592,441, uses forty-two transducers on the vertices of a regular geodesic two frequency icosahedron. While Kuhn may produce the desired directionality, it is clear that Kuhn is quite complex and impractical for the uses envisioned above.

Another patent, issued to Elko et al, U.S. Pat. No. 4,802,227, addresses signal processing aspects of microphone arrays. Elko et al however, utilizes costly signal processing means to reduce noise. The signal processing capabilities required to keep adaptively calculating the required real-time analysis can be prohibitive.

A further patent, issued to Gorike, U.S. Pat. No. 4,904,078 uses directional microphones in eyeglasses to assist persons with a hearing disability receiving aural signals. The directional microphones, however, do not allow for a changing directionality as to the source of the sound.

The use of diffraction can effectively increase the aperture size and the directionality of a microphone array. Thus, diffractive effects and the proper design of diffractive surfaces can provide large aperture sizes and improved directivity with relatively small arrays. When implemented using superdirective beamforming, the resulting array is less sensitive to microphone self noise and errors in matching microphone amplitude and phase responses. A simple example of how a diffracting object can improve the directional performance of a system is provided by the human head and ears. The typical separation between the ears of a human is 15 cm. Measurements of two-ear correlation functions in reverberant rooms show that the effective separation is more than double this, about 30 cm, which is the ear separation around a half-circumference of the head.

Academic papers have recently suggested that diffracting structures can be used with microphone arrays. An oral paper by Kawahara and Fukudome, ("Superdirectivity design for a sphere-baffled microphone", J. Acoust. Soc. Am. 130, 2897, 1998), suggests that a sphere can be used to advantage in beamforming. A six-microphone configuration mounted on a sphere was discussed by Elko and Pong, ("A steerable and variable 1st order differential microphone array", Intl. Conf. On Acoustics, Speech and Signal Processing, 1997), noting that the presence of the sphere acted to increase the effective separation of the microphones. However, these two publications only consider the case of a rigid intervening sphere.

What is therefore required is a directional microphone array which is relatively inexpensive, small, and can be easily adapted for electro acoustic applications such as teleconferencing and hands free telephony.

SUMMARY OF THE INVENTION

The present invention uses diffractive effects to increase the effective aperture size and the directionality of a microphone array along with a signal processing method which generates time delay weights, amplitude and phase delay adjustments for signals coming from different microphones in the array.

The present invention increases the aperture size of a microphone array by introducing a diffracting structure into the interior of a microphone array. The diffracting structure within the array modifies both the amplitude and phase of the acoustic signal reaching the microphones. The diffracting structure increases acoustic shadowing along with the signal's travel time around the structure. The diffracting structure in the array effectively increases the aperture size of the array and thereby increases the directivity of the array. Constructing the surface of the diffracting structure such that surface waves can form over the surface further increases the travel time and modifies the amplitude of the acoustical signal thereby allowing a larger effective aperture for the array.

In one embodiment, the present invention provides a diffracting structure for use with a microphone array, the microphone array being comprised of a plurality of microphones defining a space generally enclosed by the array wherein a placement of the structure is chosen from the group comprising the structure is positioned substantially adjacent to the space; and at least a portion of the structure is substantially within the space; and wherein the structure has an outside surface.

In another embodiment, the present invention provides a microphone array comprising a plurality of microphones constructed and arranged to generally enclose a space; a diffracting structure placed such that at least a portion of the structure is adjacent to the space wherein the diffracting structure has an outside surface.

A further embodiment of the invention provides a method of increasing an apparent aperture size of a microphone array, the method comprising; positioning a diffraction structure within a space defined by the microphone array to extend a travel time of sound signals to be received by microphones in the microphone array, generating different time delay weights, phases, and amplitudes for signals from each microphone in the microphone array, applying said time delay weights to said sound signals received by each microphone in the microphone array wherein the diffraction structure has a shape, said time delay weights are determined by analyzing the shape of the diffraction structure and the travel time of the sound signals.

Another embodiment of the invention provides a microphone array for use on a generally flat surface comprising; a body having a convex top and an inverted truncated cone for a bottom, a plurality of cells located on a surface of the bottom for producing an acoustic impedance and a plurality of microphones located adjacent to the bottom.

BRIEF DESCRIPTION OF THE DRAWINGS

A better understanding of the invention will be obtained by considering the detailed description below, with reference to the following drawings in which:

FIGS. 7A to 24A illustrates top views of some possible diffracting structures and microphone arrays.

FIGS. 7B to 24B illustrate corresponding side view of the diffracting structures of FIGS. 7A to 24A.

DESCRIPTION OF THE PREFERRED EMBODIMENTS

Figure 1:
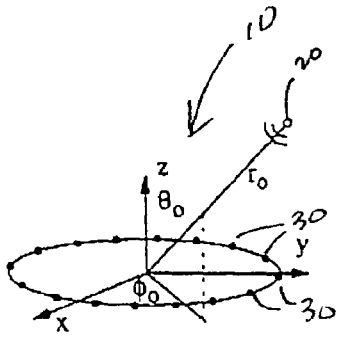
FIG. 1 is a diagram of a circular microphone array detailing the variables used in the analysis below.

To analyse the effect of introducing a diffracting structure in a microphone array, some background on array signal processing is required.

In a microphone array the separate signals from the separate microphones are weighted and summed with a processor to provide an output signal. This process is represented by the equation:

$$V \propto \sum_{m=1}^{M} w_m p_m$$

where V is the electrical output signal;

$w_m$ is the weight assigned to the particular microphones;

M is the number of microphones; and $p_m$ is the acoustic pressure signal from a microphone.

The weights are complex and contain both an amplitude weighting and an effective time delay $\tau_m$, according to $$w_m = |w_m| e^{(+i\omega\tau_m)}$$

where ω is the angular sound frequency. An $e^{(-iwt)}$ time dependence is being assumed. Both amplitude weights and time delays are, in general, frequency dependent.

Useful beampatterns can be obtained by using a uniform weighting scheme, setting $|w_m|=1$ and choosing the time delay $\tau_m$ so that all microphone contirbutions are in phase when sound comes form a desired direction. This approach is equivalent to delay-and-sum beamforming for an array in free space. When acoustical noise is present, improved beamforming performance can be obtained by applying optimization techniques, as discussed below.

The acoustic pressure signal $p_m$ from microphone m consists of both a signal component $s_m$ and a noise component $n_m$ where $$p_m = s_m + n_m$$

An array is designed to enhance reception of the signal component while suppressing reception of the noise component. The array's ability to perform this task is described by a performance index known as array gain.

Array gain is defined as the ratio of the array output signal-to-noise ratio over that of an individual sensor. For a specific frequency ω the array gain G(ω) can be written using matrix notation as $$G(f) = \frac{E\{|W^H S|^2\} / (E\{|W^H N|^2\})}{\sigma_s^2 / \sigma_n^2} = \frac{E\{W^H S \cdot S^{HW}\}/\sigma_s^2}{E\{W^H N \cdot N^H W\}/\sigma_n^2} \quad (1)$$

In this expression, W is the vector of sensor weights $$W^T = [w_1(\omega) w_2(\omega) \ldots w_M(\omega)],$$

s is the vector of signal components $$S^T=[s_1(\omega)s_2(\omega)\ldots s_M(\omega)],$$

N is the vector of noise components $$N^T=[n_1(\omega)n_2(\omega)\ldots n_M(\omega)],$$

$\sigma_s^2$ and $\sigma_n^2$ are the signal and noise powers observed at a selected reference sensor, respectively, and E{ } is the expectation operator.

By defining the signal correlation matrix $R_{ss}(\omega)$ $$R_{ss}(\omega)=E\{S\cdot S^H\}/\sigma_s^2 \tag{2}$$

and the noise correlation matrix $R_{nn}(\omega)$ $$R_{ss}(\omega)=E\{N\cdot N^H\}/\sigma_n^2 \tag{3}$$

the above expression for array gain becomes $$G(\omega)=\frac{W^H R_{ss}(\omega)W}{W^H R_{nn}(\omega)W}. \tag{4}$$

The array gain is thus described as the ratio of two quadratic forms (also known as a Rayleigh quotient). It is well known in the art that such ratios can be maximized by proper selection of the weight vector W. Such maximization is advantageous in microphone array sound pickup since it can provide for enhanced array performance for a given number and spacing of microphones simply by selecting the sensor weights W.

Provided that $R_{nn}(\omega)$ is non-singular, the value of $G(\omega)$ is bounded by the minimum and maximum eigenvalues of the symmetric matrix $R_{nn}^{-1}(\omega)\,R_{ss}(\omega)$. The array gain is maximized by setting the weight vector W equal to the eigenvector corresponding to the maximum eigenvalue.

In the special case where $R_{ss}(\omega)$ is a dyad, that is, it is defined by the outer product $$R_{ss}(\omega)=SS^H \tag{5}$$

then the weight vector $W_{opt}$ that maximizes $G(\omega)$ is given simply by $$W_{opt}=R_{nn}^{-1}(\omega)S. \tag{6}$$

It has been shown that the optimum weight solutions for several different optimization strategies can all be expressed as a scalar multiple of the basic solution $$R_{nn}^{-1}(\omega)S.$$

The maximum array gain $G(\omega)_{opt}$ provided by the weights in (6) is $$G(\omega)_{opt}=S^H R_{nn}^{-1}(\omega)S. \tag{7}$$

Specific solutions for $W_{opt}$ are determined by the exact values of the signal and noise correlation matrices, $$R_{ss}(\omega) \text{ and } R_{nn}(\omega)$$

Optimized beamformers have the potential to provide higher gain than available from delay-and-sum beamforming. Without further constraints, however, the resulting array can be very sensitive to the effects of microphone response tolerances and noise. In extreme cases, the optimum gain is impossible to realize using practical sensors.

A portion of the optimized gain can be realized, however, by modifying the optimization procedure. The design of an optimum beamformer then becomes a trade-off between the array's sensitivity to errors and the desired amount of gain over the spatial noise field. Two methods that provide robustness against errors are considered: gain maximization with a white-noise gain constraint and maximization of expected array gain.

Regarding gain maximization with a white-noise gain constraint, white noise gain is defined as the array gain against noise that is incoherent between sensors. The noise correlation matrix in this case reduces to an M×M identity matrix. Substituting this into the expression for array gain yields $$G_w(\omega)=\frac{W^H R_{ss}(\omega)W}{W^H IW} \tag{8}$$

White noise gain quantifies the array's reduction of sensor and preamplifier noise. The higher the value of $G_w(\omega)$, the more robust the beamformer. As an example, the white noise gain for an M-element delay-and-sum beamformer steered for plane waves is M. In this case, array processing reduces uncorrelated noise by a factor of M (improves the signal-to-noise ratio by a factor of M).

A white noise gain constraint is imposed on the gain maximization procedure by adding a diagonal component to the noise correlation matrix. That is, replace $R_{nn}(\omega)$ by $R_{nn}(\omega)+\kappa I$. The strength of the constraint is controlled by the magnitude of κ. Setting κ to a large value implies that the dominant noise is uncorrelated from microphone to microphone. When uncorrelated noise is dominant, the optimum weights are those of a conventional delay-and-sum beamformer. Setting κ=0, of course, produces the unconstrained optimum array. Unfortunately, there is no simple relationship between the constraint parameter κ and the constrained value of white noise gain. Designing an array for a prescribed value of $G_w(\omega)$ requires an iterative procedure. The optimum weight vector is thus $$W_{opt}=(R_{ss}(\omega)+\kappa I)^{-1}S$$

where it is assumed that $R_{ss}(\omega)$ is given by Equation 5.

Of course, a suitable value of $G_w(\omega)$ must be selected. This choice will depend on the exact level of sensor and preamplifier noise present. Lower sensor and preamplifier noise permits more white noise gain to be traded for array gain. As an example, the noise level (in equivalent sound pressure level) provided by modern eleuctret microphones is of the order of 20–30 dBSL (that is, dB re: $20\times10^{-6}$ Pa) whereas the acoustic background noise level of typical offices are in the vicinity of 30–45 dBSL. Since the uncorrelated sensor noise is about 10–15 dB lower than the acoustic background noise (due to the assumed noise field) it is possible to trade off some of the sensor SNR for increased rejection of environmental noise and reverberation.

To maximize the expected array gain, the following analysis applies. For an array in free space, the effects of many types of microphone errors can be accommodated by constraining white noise gain. Since the acoustic pressure observed at each microphone is essentially the same the levels of sensor noise and the effects of microphone tolerances are comparable between microphones. In the presence of a diffracting object, however, the pressure observed at a microphone on the side facing the sound source may be substantially higher than that observed in the acoustic shadow zone. This means that the relative importance of microphone noise varies substantially with the different microphone positions. Similarly, the effects of microphone gain and phase tolerances also vary widely with microphone location.

To obtain a practical design in the presence of amplitude and phase variations, an expression for the expected array gain must be obtained. The analysis of this problem is facilitated by assuming that the actual array weights described by the vector W vary in amplitude and phase about their nominal values $W_0$. Assuming zero-mean, normally distributed fluctuations it is possible to evaluate the expected gain of the beamformer. The expression is $$E\{G(\omega)\} = \frac{e^{-\sigma_p^2}(W_0^H R_{ss}(\omega)W_0) + \left(1 - e^{-\sigma_p^2} + \sigma_m^2\right)(W_0^H diag(R_{ss}(\omega))W_0)}{e^{-\sigma_p^2}(W_0^H R_{nn}(\omega)W_0) + \left(1 - e^{-\sigma_p^2} + \sigma_m^2\right)(W_0^H diag(R_{nn}(\omega))W_0)} \tag{9}$$

where $\sigma_m^2$ is the variance of the magnitude fluctuations and $\sigma_p^2$ is the variance of the phase fluctuations due to microphone tolerance.

Although this expression is more complicated than that shown in (4), it is still a ratio of two quadratic forms. Provided that the matrix A is non-singular, the value of the ratio is bounded by the minimum and maximum $$A^{-1}B$$

where $$A=(e^{-\sigma P^2}R_{nn}(\omega)+(1-e^{-\sigma P^2})diag(R_{nn}(\omega)))$$

and $$B=(e^{-\sigma P^2}R_{ss}(\omega)+(1-e^{\sigma P^2}+\sigma_m^2)diag(R_{ss}(\omega)))$$

The expected gain $E\{G(\omega)\}$ is maximized by setting the weight vector $W_0$ equal to the eigenvector which corresponds to the maximum eigenvalue.

Notwithstanding the above optimization procedures, useful beampatterns can be obtained by using a uniform weighting scheme. This approach is equivalent to delay-and-sum beamforming for an array in free space.

In the following analyses, we will set the time delay $\tau_m$ so that all microphone contributions are in phase when sound comes from a desired direction and simply adopt unit amplitude weights $|\omega_m|=1$. The output of a 3 dimension array is then given by Equation 10:

$$V \propto \sum_{m=1}^{m} p_m e^{(+i\omega\tau_m)} \tag{10}$$

Figure 2:
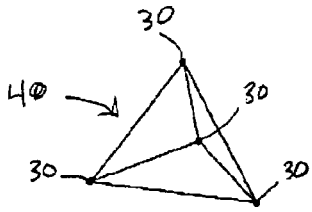
FIG. 2 is a diagram of a tetrahedral microphone array.

Two examples of such an array are shown in FIGS. 1 and 2. FIG. 1 shows a circular array 10 with a sound source 20 and a multiplicity of microphones 30. FIG. 2 shows a tetrahedral microphone array 40 with microphones 30 located at each vertex.

For the circular array 10, a source located at a position ($r_o$, $\theta_o$, $\phi_o$) (with $r_o$=distance from the center of the array $\theta_o$=angle to the positive z-axis as shown in FIG. 1

$\phi_o$=angle to the positive x-axis as shown in FIG. 1)

the pressures at each microphone 30 is given by Equation 11:

$$p_{mo} = \frac{C\exp(ikr_{mo})}{kr_{mo}}, \tag{11}$$

where C is a source strength parameter and the distances between source and microphones are $$r_{mo}=[r_o^2+a^2-2r_o a \sin\theta_o \cos(\phi_m-\phi_o)]^{1/2};$$

where a is the radius of the circle, $\phi_m$ is the azimuthal position of microphone m. The array output is thus given by Equation 12:

$$V \propto \sum_{m=1}^{m} p_{mo} e^{(+i\omega\tau_m)} \tag{12}$$

Suppose it is desired to steer a beam to a look position ($r_l$, $\theta_l$, $\phi_l$) where $\theta_l$ is the azimuth and $\phi_1$ is the elevation angle. The pressure $p_m$ that would be obtained at each microphone position if the source was at this look position are $$p_{ml} = \frac{C\exp(ikr_{ml})}{kr_{ml}}$$

where $$r_{ml}=[r_l^2+a^2-2r_l a \sin\theta_l \cos(\phi_m-\phi_l)]^{1/2}.$$

To bring all the contributions into phase when the look position corresponds to the actual source position, the phase of the weights need to be set so that $$\omega\tau_m=-kr_{ml}$$

The beamformer output is then given by Equation 13:

$$V \propto \sum_{m=1}^{M} \frac{\exp[ik(r_{mo} - r_{ml})}{kr_{mo}} \tag{13}$$

Figure 3:
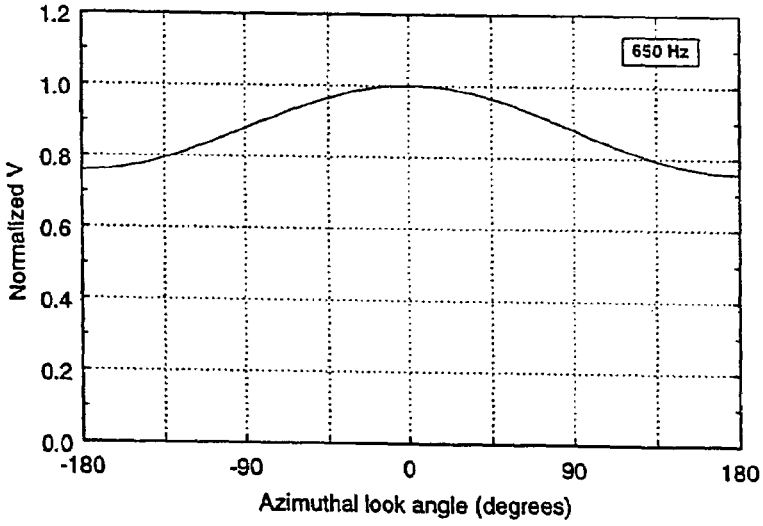
FIG. 3 illustrates a directional beam response for a circular array.

A sample response function is shown in FIG. 3. A 5-element circular array of 8.5 cm diameter located in free space has been assumed. The source is located at a range of 2m and at an angular positions of $\phi_0$=0 and $\theta_0$=Π/2. For the look position, $r_l$=2m, $\theta_l$=Π/2 and the azimuth $\phi_l$ is varied. It should be noted that the directional beam response pictured in FIG. 3 is for a frequency of 650 Hz and that uniform weights have been assumed.

The response function in FIG. 3 can be improved upon by inserting a diffracting structure inside the array. An example of this is pictured in FIG. 4.

Figure 4:
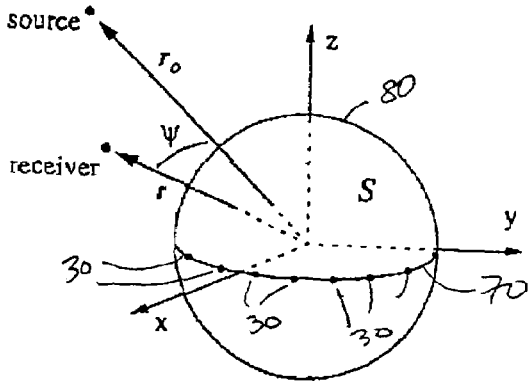
FIG. 4 illustrates a circular microphone array with a spherical diffracting structure within the array.

FIG. 4 illustrates a circular array with a spherical diffracting structure positioned within the array.

Figure 5:
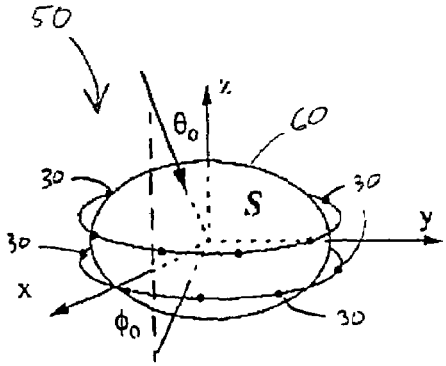
FIG. 5 illustrates a bi-circular microphone array with an oblate spheroid shaped diffracting structure inside the array.

FIG. 5 illustrates another configuration using a diffracting structure. FIG. 5 shows a bi-circular array 50 with a diffracting structure 60 mostly contained within the space defined by the bi-circular array 50.

To determine the response function for an array such as that pictured in FIG. 4, some of the assumptions made in calculating the response function shown in FIG. 3 cannot be made. While the above equations assume that the pressure at each microphone was the free-field sound pressure due to a point source, such is not the case with an array having a diffracting structure. A diffracting structure should have a surface S that can be defined by an acoustic impedance function. Subject to the appropriate boundary conditions on the surface S of the diffracting structure 60, the acoustic wave equation will have to be solved to determine the sound pressure over the surface. Diffraction and scattering effects can then be included in the beamforming analysis.

For such an analysis, a source at a position given by $r_o=(r_o, \theta_o, \phi_o))$ is assumed. For this source, the boundary value problem is given by Equation 14:

$$\nabla^2 p+k^2 p=\delta(r-r_o) \tag{14}$$

outside the surface S of the diffracting structure 60 subject to the impedance boundary condition is given by Equation 15:

$$\left[\frac{dp}{dn}+ik\beta p\right]_s=0, \tag{15}$$

where n is the outward unit normal and β is the normalized specific admittance. Asymptotically near the source, the pressure is given by Equation 16:

$$p \rightarrow \frac{C\exp[ik|r-r_o|}{k|r-r_o|} \tag{16}$$

Solutions for a few specific structures can be expressed analytically but generally well known numerical techniques are required. Regardless, knowing that a solution does exist, we can write down a solution symbolically as $$p(r)=F(r,r_o)$$

where $F(r, r_o)$ is a function describing the solution in two variables r and $r_o$.

Evaluating the pressure $p_{mo}$ at each microphone position $r_m$ we have:

$$p_{mo}=F(r_m,r_o)$$

giving a uniform weight beamformer output (Equation 17)

$$V \propto \sum_{m=1}^{M} F(r_m, r_o) \quad \exp(i\omega\tau_m). \tag{17}$$

The pressure at each microphone will vary significantly in both magnitude and phase because of diffraction.

Suppose that a beam is to be steered toward a look position $r_l=(r_l, \theta_l, \phi_l)$ The microphone pressures that would be obtained if this look position corresponded to the actual source position would be $$P_{ml}=F(r_m,r_l)$$

The time delays $\tau_m$ are then set according to Equation 18

$$\omega\tau_m=-a\ rg[F(r_m,r_l)], \tag{18}$$

where $\arg[Fr_m, r_l)]$ denotes the argument of the function $F(r_m, r_l)$.

As noted above, FIG. 4 shows an example of the above. FIG. 4 is a circular array 70 on the circumference of a rigid surface 80. The solution for the sound field about a rigid sphere due to a point source is known in the art. For a source with free-field sound field as given by Equation 16, the total sound field is given by Equation 19:

$$F(r, r_o) = iC\sum_{n=0}^{\infty} (2n+1)P_n(\cos\psi)h_n^{(1)}(kr_>)[j_n(kr_<) - a_n h_n^{(1)}(kr_<)] \tag{19}$$

where ψ is the angle between vectors r and $r_0$, $P_n$ is the Legendjre polynomial of order n, $j_n$ is the spherical Bessel function of the first kind and order n, $h_n^{(1)}$ is the spherical Hankel function of the first kind and order n, $r_<=\min(r, r_0)$, $r_>=\max(r, r_0)$, and $$a_n=j_n'(ka)/h_n^{(1)\prime}(ka),$$

where the ' indicates differentiation with respect to the argument kr. To obtain $F(r, r_l)$, $r_l$ is used in place of $r_0$ in Equation 19. The solutions can be evaluated at each microphone position $r=r_m$.

This solution is then used in the evaluation of the beamformer output V. For a ciruclar array 8.5 cm in diameter with 5 equally spaced microphones in the X-Y plane forming the array and on the circumference of an acoustically rigid sphere, the response function is shown in FIG. 6.

Figure 6:
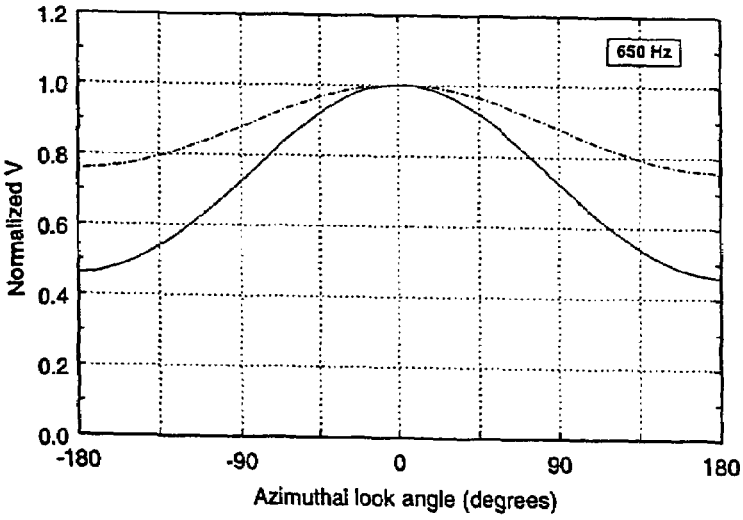
FIG. 6 illustrates the beamformer response for a circular array with a spherical diffracting structure (solid curve) and the response for a circular array without a diffracting structure (dashed curve)

For the response function shown in FIG. 6, a 650 Hz point source was located in the plane of the microphones with $r_0=2$, $\theta_0=\Pi/2$, and $\phi_0=0$. The look position has $r_l=2$m and $\theta_l=\Pi/2$ fixed. The response V as a function of azimuthal look angle $\phi_l$ is shown as the solid line in FIG. 6. For comparison, the beamformer response obtained with no sphere has been calculated using Equation 13 and this result shown as the dashed line in FIG. 6.

The inclusion of the diffracting sphere is seen to enhance the performance of the array by reducing the width of the central beam.

While the circular array was convenient for its mathematical tractability, many other shapes are possible for both the microphone array and the diffracting structure. FIGS. 7 to 24 illustrate these possible configurations.

Figure 7A:
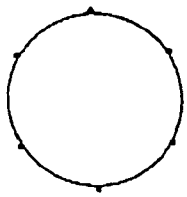
Figure 7B:
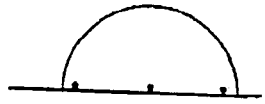
Figure 8A:
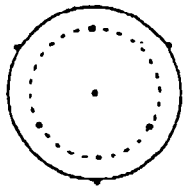
Figure 8B:
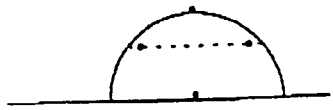
Figure 9A:
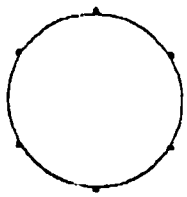
Figure 9B:
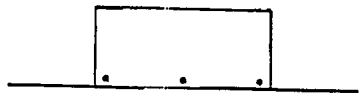
Figure 10A:
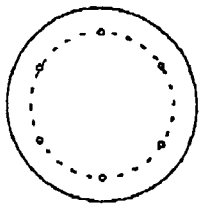
Figure 10B:
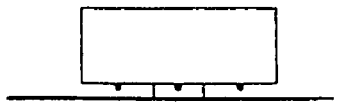
Figure 11A:
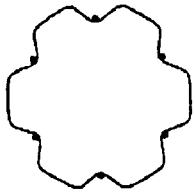
Figure 11B:
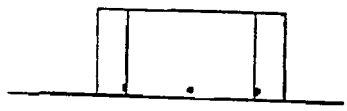
Figure 12A:
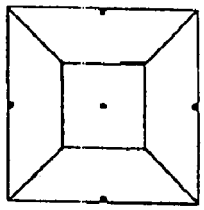
Figure 12B:
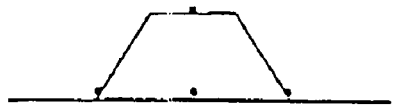
Figure 13A:
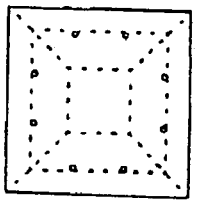
Figure 13B:
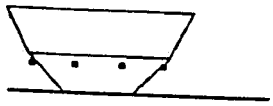
Figure 14A:
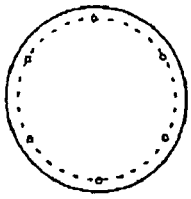
Figure 14B:
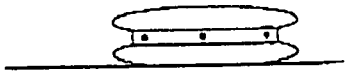

The configurations pictured with a top view and a side view are as follows:

| | Microphone Array | Diffracting Structure |
|---|---|---|
| FIGS. 7A & B | Circular | hemisphere |
| FIGS. 8A & B | bi-circular | hemisphere |
| FIGS. 9A & B | circular | right circular cylinder |
| FIGS. 10A & B | circular | raised right circular cylinder |
| FIGS. 11A & B | circular | cylinder with a star shaped cross section |
| FIGS. 12A & B | square pyramid | truncated square pyramid |
| FIGS. 13A & B | square | inverted truncated square pyramid with a generally square cross section |
| FIGS. 14A & B | circular | right circular cylinder having |

-continued

Figure 15A:
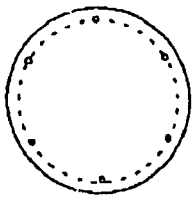
Figure 15B:
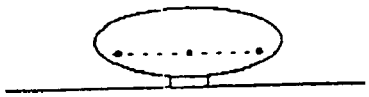
Figure 16A:
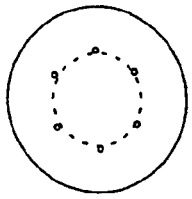
Figure 16B:
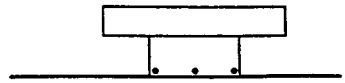
Figure 17A:
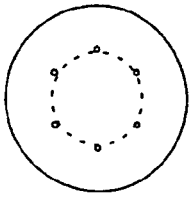
Figure 17B:
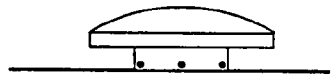
Figure 18A:
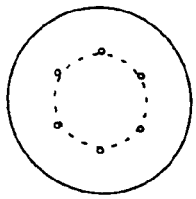
Figure 18B:
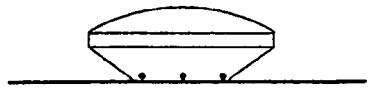
Figure 19A:
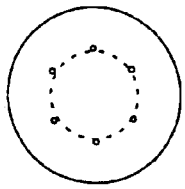
Figure 19B:
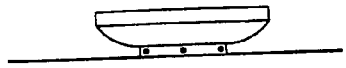
Figure 20A:
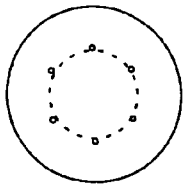
Figure 20B:
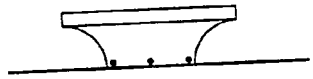
Figure 21A:
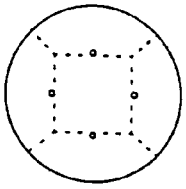
Figure 21B:
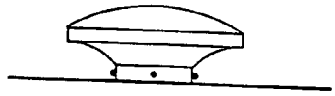
Figure 22A:
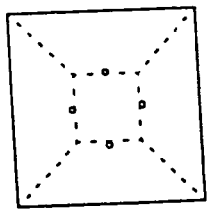
Figure 22B:
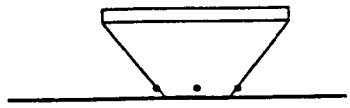
Figure 23A:
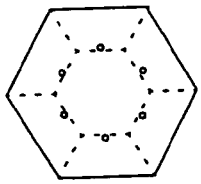
Figure 23B:
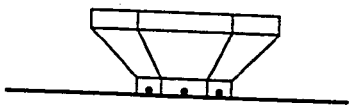
Figure 24A:
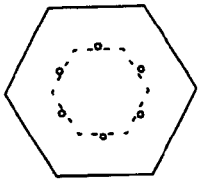
Figure 24B:
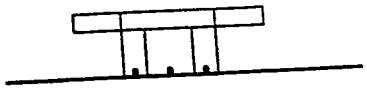

| | Microphone Array | Diffracting Structure |
|---|---|---|
| | | an oblate spheroid at each end |
| FIGS. 15A & B | circular | raised oblate spheroid |
| FIG. 16A & B | circular | flat shallow solid cylinder raised from a surface |
| FIG. 17A & B | circular | shallow solid cylinder haivng a convex top & being raised from a surface |
| FIG. 18A & B | circular | circular shape with a convex top and a truncated cone as its base |
| FIG. 19A & B | circular | shallow cup shaped cross section raised from a surface |
| FIG. 20A & B | circular | shallow solid cylinder with a flared bottom |
| FIG. 21A & B | square | circular shape with a convex top and a flared square base opening to the circular shape |
| FIG. 22A & B | square | truncated square pyramid |
| FIG. 23A & B | hexagonal | truncated hexagonal pyramid |
| FIG. 24A & B | hexagonal | shallow hexagonal solid cylinder raised from the surface by a hexagonal stand |

It should be noted that in the above described figures, the black dots denote the position of microphones in the array. Other shapes not listed above are also possible for the diffracting structure.

As can be seen from FIGS. 7 to 24, the placement of the microphone array can be anywhere as long as the diffracting structure, or at least a portion of it, is contained within the space defined by the array.

To determine the improvement in spatial response due to a diffracting structure, the directivity index D is used. This index is the ratio of the array response in the signal direction to the array response averaged over all directions. This index is given by equation 20:

$$D = 10\log\left\{\frac{|V(r_o)/r_o|^2}{\frac{1}{4\pi}\int_0^{2\pi}\int_0^{\pi}|V(r_\infty)/r_\infty|^2\sin\theta\, d\theta\, d\phi}\right\} \tag{20}$$

and is expressed in decibels. The numerator gives the beamformer response when the array is directed toward the source, at range $r_0$; the denominator gives the average response over all directions. This expression is mathematically equivalent to that provided for array gain if a spherically isotropic noise model is used for $R_m(\omega)$.

Figure 25:
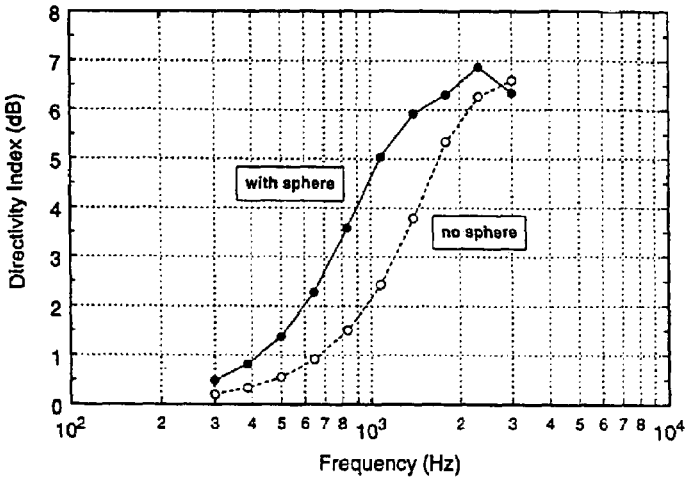
FIG. 25 is a plot comparing the directivity of a circular array having a diffracting structure within the array with the directivity of the same circular array without the diffracting structure.

Using this expression for the conditions presented in FIG. 6, a directivity of 2.3 dB is calculated for the circular array with a sphere present; without the sphere the directivity is 0.9 dB. At a frequency of 650 Hz, the inclusion of a diffracting sphere improves the directivity by 1.4 dB. The directivity for other frequencies has been calculated and presented in FIG. 25. It is seen that improvements of at least 2 dB in directivity index are achieved in the 800–1600 Hz range.

Another consequence of an increase in directivity is the reduction in size that becomes possible for a practical device. Comparing the two curves in FIG. 25, we see that with the sphere present, the array performs as well at 500 Hz as the array without the sphere would perform at 800 Hz, a ratio of 1.6; at higher frequencies, this ratio is about 1.2. It is known that the performance of an array depends on the ratio of size to wavelength. Hence, the array with the sphere could be reduced in size by a factor of 1.4 and have approximately the same performance as the array with no sphere. This 30% reduction in size would be very important to designers of products such as handsfree telephones or arrays for hearing aids where a smaller size is important. Moreover, once the size is reduced, the number of microphones could be reduced as well.

Additional performance enhancements can be obtained by appropriate treatment of the surface of the diffracting objects. The surfaces need not be acoustically-rigid as assumed in the above analysis. There can be advantages in designing the exterior surfaces to have an effective acoustical surface impedance. Introducing some surface damping (especially frequency dependent damping) could be useful in shaping the frequency response of the beamformer. There are however, particular advantages in designing the surface impedance so that the air-coupled surface waves can propagate over the surface. These waves travel at a phase speed lower than the free-field sound speed. Acoustic signals propagating around a diffracting object via these waves will have an increased travel time and thus lead to a larger effective aperture of an array.

Figure 26:
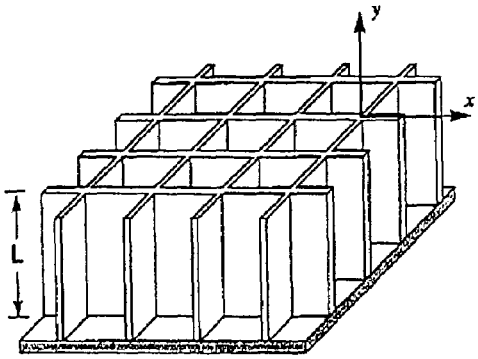
FIG. 26 illustrates the construction of a surface wave propagating surface for the diffracting structures.

The existence and properties of air-coupled surface waves are known in the art. A prototypical structure with a plurality of adjacent cells is shown in FIG. 26. A sound wave propagating horizontally above this surface interacts with the air within the cells and has its propagation affected. This may be understood in terms of the effective acoustic surface impedance Z of the structure. Plane-wave-like solutions of the Helmholtz equation, $$p \propto e^{i\alpha x} e^{i\beta y}$$

for the sound pressure p, are sought subject to the boundary condition $$\left(\frac{dp}{dy} + \frac{i\rho\omega}{Z}p\right)_{y=0} = 0,$$

where x and y are coordinates shown in FIG. 26, $k=\overline{\omega}/c$ is the wave number, $\overline{\omega}$ is the angular frequency, p is the air density, $i=\sqrt{-1}$, and an exp $(-i\overline{\omega}t)$ time dependence is assumed. Then, the terms α and β in the Helmholtz equation are given by $$\alpha/k=\sqrt{1-(\rho c/Z)^2}$$

and $$\beta/k=-\rho c/Z.$$

For a surface wave to exist, the impedance Z must have a spring-like reactance X, i.e., for Z=R+iX, X>0 is required. Moreover, for surface waves to be observed practically, we require R<X and 2<X/σc<6. The surface wave is characterized by an exponential decrease in amplitude with height above the surface.

If the lateral size of the cells is a sufficiently small fraction of a wavelength of sound, then sound propagation within the cells may be assumed to be one dimensional. For the simple cells of depth L shown in FIG. 17, the effective surface impedance is $$Z=i\rho c \cot kL,$$

so surface waves are possible for frequencies less than the quarter-wave resonance.

To exploit the surface-wave effect, microphones may be mounted anywhere along the length of the cells. At frequencies near cell resonance, however, the acoustic pressure observed at the cell openings and at other pressure nodal points will be very small. To use the microphone signals at these frequencies, the microphones should be located along the cell's length at points away from pressure nodal points. This can be achieved for all frequencies if the microphones are located at the bottom of the cells since an acoustically rigid termination is always an antinodal point.

The phase speed of a propagating surface wave is $$c_{ph}=\omega/Re\{\alpha\}.$$

Figure 27:
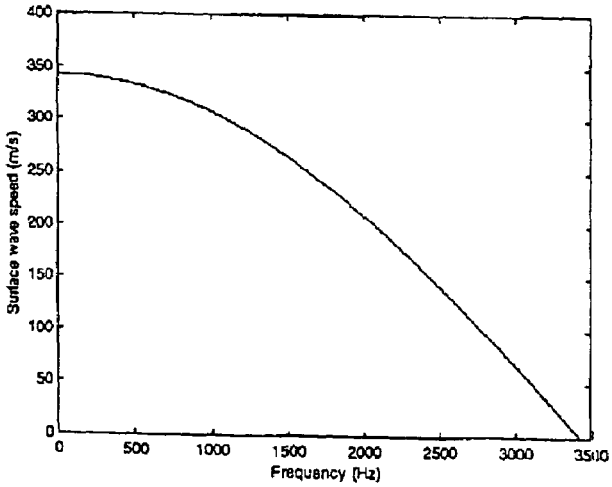
FIG. 27 plots the surface wave phase speed for a simple celled construction as pictured in FIG. 17.

For the simple surface structure shown in FIG. 26, using a cell depth of L=2.5 cm, we obtain the phase speed shown in FIG. 27. The phase speed is the free-field sound speed at low frequencies but drops gradually to zero at about 3400 Hz. Above this frequency, the reactance is negative and no surface wave can propagate. The reduced phase speed increases the travel time for acoustic signals to propagate around the structure and results in improved beamforming performance.

Figure 28:
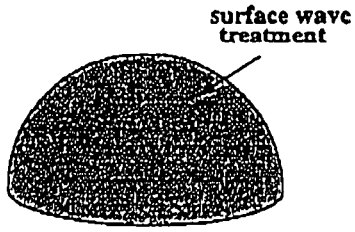
FIGS. 28–31 illustrate different configurations for coating the diffracting surface.
Figure 29:
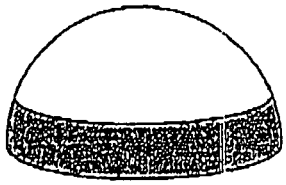
Figure 30:
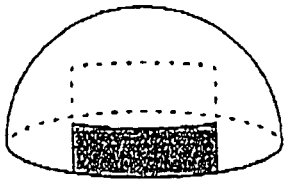
Figure 31:
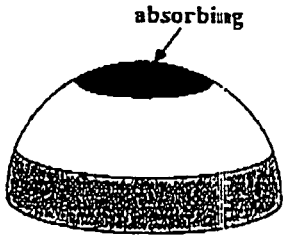

FIGS. 28–31 show a few alternatives that the surface of a diffracting structure can be treated to generate surface waves. For these, a hemispherical structure has been adopted for simplicity but, as suggested in FIGS. 9–24, many other structures are possible. In FIG. 28, the entire surface supports the formation of surface waves. The introduction of the surface treatment to a diffracting structure need not be uniform over its surface and advantages in directionality may be achievable by restricting the application. In FIG. 29, the surface wave treatment is restricted to a band about the lower circumference; increased directivity would be anticipated for sources located closer to the horizontal plane through the hemisphere. Further reduction in scope, to provide increased directivity for a smaller range of source positions, is shown in FIG. 30. The use of absorbing materials or treatment may also be useful. An absorbing patch on the top of the hemisphere, to reduce contributions from acoustic propagation over the top of the structure is shown in FIG. 31.

Figure 32:
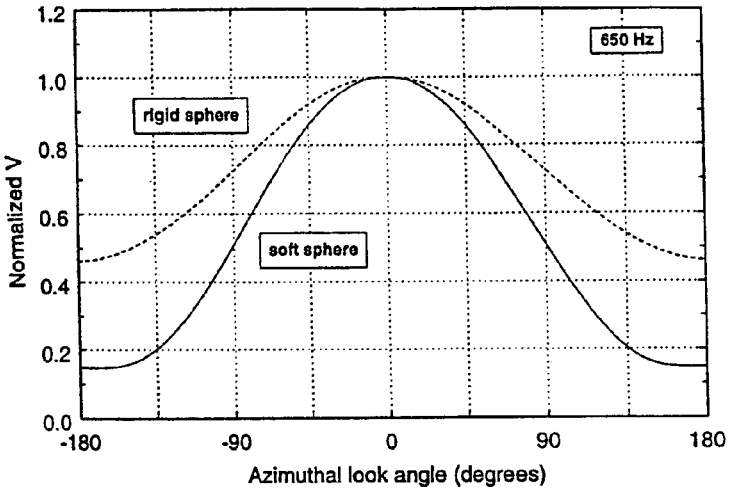
FIG. 32 is a plot of the directional beam response for a hemispherical diffracting structure. The plots for a rigid and a soft diffracting structure are plotted on the same graph for ease of comparison.
Figure 33:
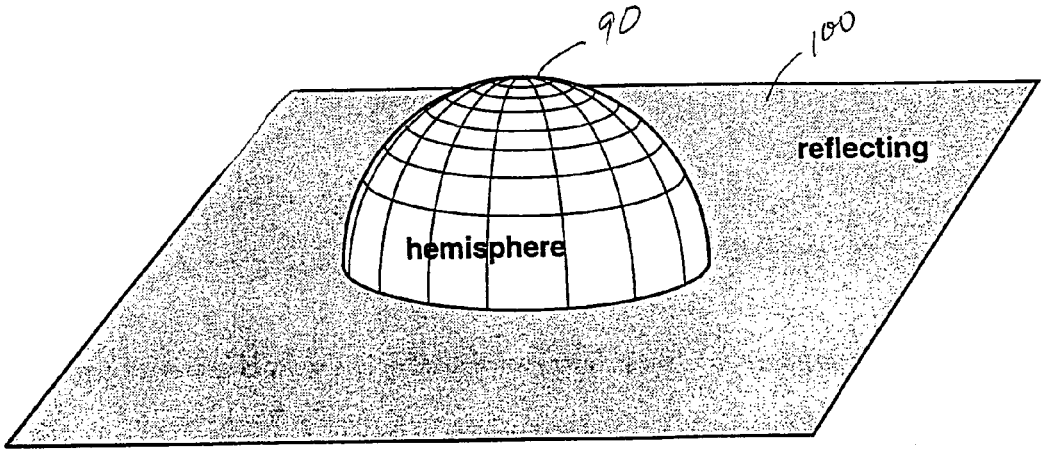
FIG. 33 is the diffracting structure used for FIG. 32.
Figure 34:
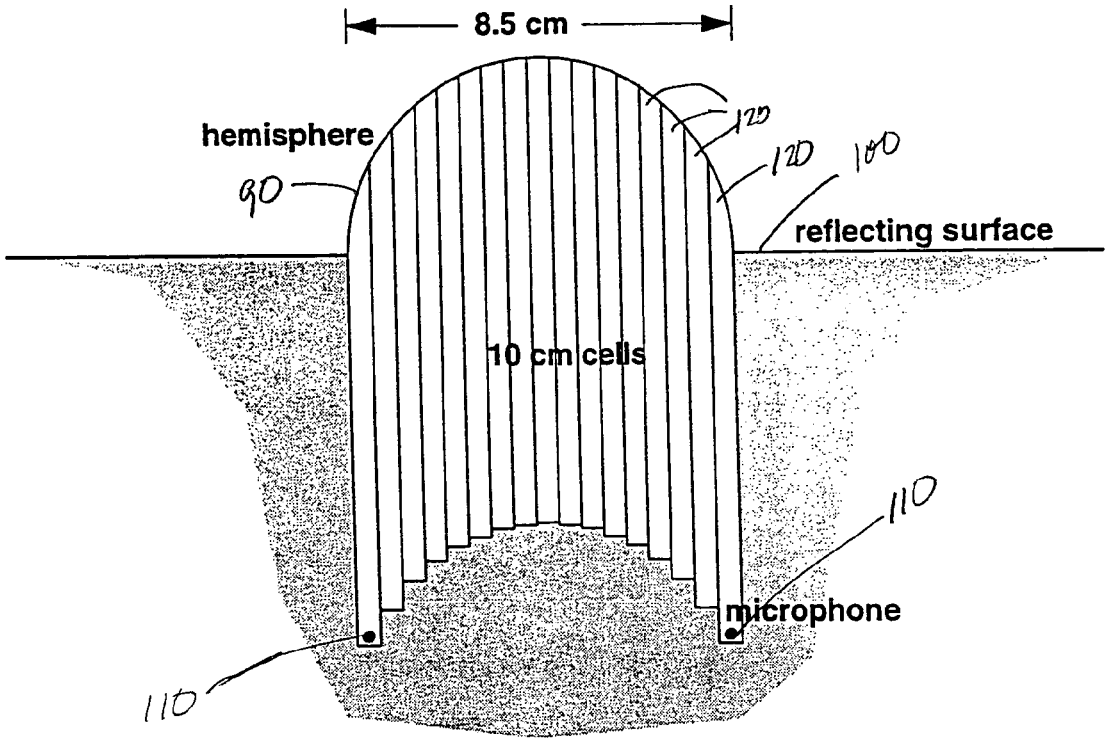
FIG. 34 is a cross-sectional diagram of the cellular structure of the diffracting structure shown in FIG. 33.

The effect of such a surface treatment on the beam pattern of a 6-microphone delay-and-sum beamformer mounted on a hemisphere 90 8.5 cm in diameter is shown in FIG. 32. The hemisphere 90 is shown in FIG. 33 and is mounted on a reflecting plane 100 and the microphones 110 are equally spaced around the circumference of the hemisphere at the bottom of the cells 120. The cross sectional structure of the cells 120 are shown in FIG. 34. The 10 cm cells give a surface impedance, at the hemisphere surface, that is spring-like at 650 Hz. For the response patterns shown in FIG. 32, a 650 Hz point source was located in the plane of the microphones 110 with $r_0$=2, $\theta_l$=Π/2, and $\phi_0$=0. The look position has $r_1$=2m and $\theta_l$=Π/2 fixed. The response V as a function of azimuthal look angle $\phi_1$ is shown as the solid line in FIG. 32. The dashed line shows the response obtained for a rigid hemisphere with te microophones located on the outer surface at the base of the hemisphere.

The inclusion of the surface treatment is seen to enhance the array performance substantially. The width of the main beam at half height is reduced from ±147° for the rigid sphere to ±90° for the soft sphere. Furthermore, the directivity index at 650 Hz increases by 2.4 dB.

The cellular surface described is one method for obtaining a desired acoustical impedance. This approach is attractive since it is completely passive and the impedance can be controlled by modifying the cell characteristics but there are practical limitations to the impedance that can be achieved.

Another method to provide a controlled acoustical impedance is the use of active sound control techniques. By using a combination of acoustic actuator (e.g. loudspeaker), acoustic sensor (e.g. microphone) and the appropriate control circuitry a wider variety of impedance functions can be implemented. (See for example U.S. Pat. No. 5,812,686).

Figure 35:
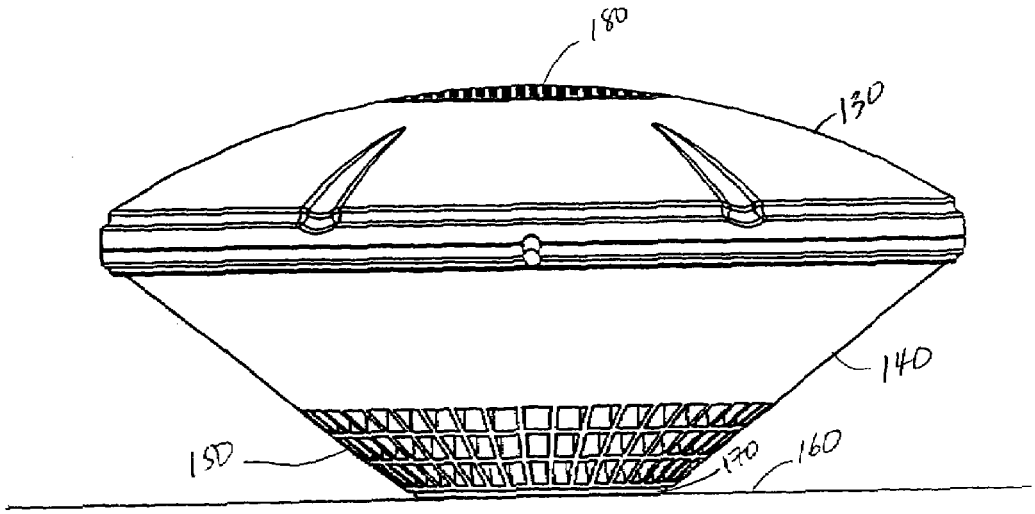
FIG. 35 is a preferred embodiment of a microphone array utilizing the methods and concepts of the invention.

A design which encompasses the concepts disclosed above is depicted in FIG. 35. The design in FIG. 35 is of a diffracting structure with a convex top 130 and an inverted truncated cone 140 as its base. The inverted truncated cone 140 has, at its narrow portion, a cellular structure 150 which serves as the means to introduce an acoustical impedance. As will be noted below, the microphones are located inside the cells. The maximum diameter is 32 cm, the bottom diameter is 10 cm. This unit is designed to rest on a table top 160 which serves as a reflecting plane. The sloping sides of the truncated cone 140 make an angle of 38° with the table top. There are 3 rows of cells circling the speakerphone, each row containing 42 vertical cells. The 3 rows have a cell depth of 9.5 cm: these are the cells that were introduced to produce the appropriate acoustical surface impedance. To accommodate the cells, the top of the housing had to be 15 cm above the table top. Included in this height is 2.9 mm for an O-ring 170 on the bottom. The separators between the cells are 2.5 mm thick. Six microphones were called for in this design, to be located in 6 equally-spaced cells of the bottom row, at the top, innermost position in the cells. The o-ring 170 prevents sound waves from leaking via the underside, from one side of the cone 140 to the other. The table top 160 acts as a reflecting surface from which sound waves are reflected to the cells. Also included in the design is a speaker placement 180 at the top of the convex top 130.

Figure 36:
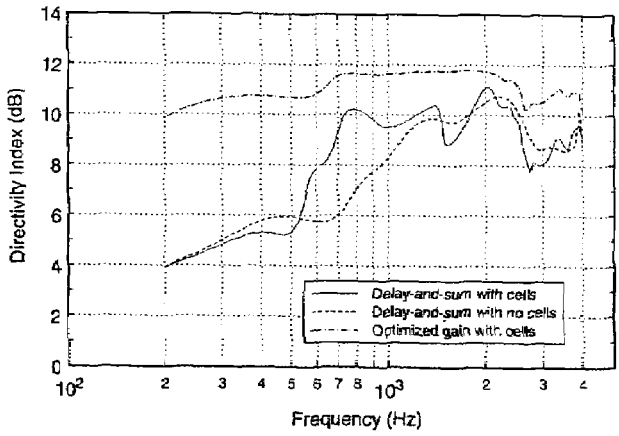
FIG. 36 is a plot of the beamformer response obtained using the microphone array of FIG. 35 both with and without a cellular structure and with optimization.

The array beamforming is based on, and makes use of, the diffraction of incoming sound by the physical shape of the housing. Computation of the sound fields about the housing, for various source positions and sound frequencies from 300 Hz to 4000 Hz, was conveniently performed using a boundary element technique. Directivity indices achieved using delay-and-sum and optimized beamforming are shown in FIG. 36 as a function of frequency. Results are shown for the housing with no cells (dashed line) as well as for the housing with three rows of cells open as described above (solid line). Also shown are results for the housing with cells and optimization (dash and dot lines). As seen in FIG. 36, the use of cells to control the surface impedance has a beneficial effect on the directivity index. An increase in directivity index is observed between 550 Hz to 1.6 kHz with a boost of approximately 4 dB obtained in the range of 700 Hz to 800 Hz. The use of array-gain optimization, as described by equation 9, is shown in FIG. 36 to further increase the directivity of the device by approximately 6 dB at 200 Hz.

The person understanding the above described invention may now conceive of alternative design, using the principles described herein. All such designs which fall within the scope of the claims appended hereto are considered to be part of the present invention.

The embodiments of the invention in which an exclusive property or privilege is claimed are defined as follows:

1. A microphone apparatus with passive beam steering, comprising:

a microphone array;

a diffracting structure proximate said a microphone array to modify the acoustic properties thereof, said microphone array and diffracting structure being associated with a characteristic sound field describing said acoustic properties; and a processor programmed to process weighted signals from individual microphones in said microphone array to create a steerable beam based on the location of said individual microphones and the predetermined properties of said sound field taking into account the modifying effect of said diffracting structure;

wherein the surface of said diffracting structure is configured to modify the acoustic impedance thereof;

wherein the surface of said diffracting structure includes an open-cellular structure; and wherein the lateral size of the cells forming said cellular structure is a fraction of the wavelength of the sound.

2. An apparatus as claimed in claim 1, wherein the microphones are located in said cells away from pressure nodal points.

* * * * *